US007904008B2

(12) United States Patent
Yi

(10) Patent No.: US 7,904,008 B2
(45) Date of Patent: Mar. 8, 2011

(54) METHOD OF USING MULTIPLE DEVELOPING MEMBERS IN A SINGLE-COMPONENT DEVELOPING SYSTEM

(75) Inventor: Jang Yi, El Sobrante, CA (US)

(73) Assignee: Jang Yi, El Sobrante, CA (US)

( * ) Notice: Subject to any disclaimer, the term of this patent is extended or adjusted under 35 U.S.C. 154(b) by 0 days.

(21) Appl. No.: 12/264,224

(22) Filed: Nov. 3, 2008

(65) Prior Publication Data

US 2010/0111576 A1 May 6, 2010

(51) Int. Cl.
*G03G 15/08* (2006.01)

(52) U.S. Cl. ..... 399/266; 399/55; 399/285; 399/290

(58) Field of Classification Search ..... 399/279, 399/285, 265, 266, 290, 291, 53, 55
See application file for complete search history.

(56) References Cited

U.S. PATENT DOCUMENTS 4,131,357 A 12/1978 Forbes, 2nd
4,478,505 A * 10/1984 Tashiro ..... 399/266
4,537,494 A 8/1985 Lubinsky et al.
4,963,937 A 10/1990 Diehl
5,202,731 A 4/1993 Tanikawa et al.
5,270,782 A * 12/1993 Floyd, Jr. ..... 399/266 X
6,026,264 A * 2/2000 Wong et al. ..... 399/266
6,298,211 B1 10/2001 Stockman et al.
6,345,161 B2 * 2/2002 Mizuno ..... 399/55
6,381,424 B1 * 4/2002 Takahashi et al. ..... 399/55
6,519,435 B2 2/2003 Park et al.
6,605,402 B2 8/2003 Schein et al.

FOREIGN PATENT DOCUMENTS

JP 59-086068 A * 5/1984

* cited by examiner

*Primary Examiner* — Sophia S Chen

(57) ABSTRACT

The present invention is directed to a non-contact, single-component developing system for electrophotographic devices that enables high speed, high quality development and color development without an accumulator, or some other intermediate transfer member by employing a plurality of ancillary developing members operating in tandem with a toner-carrying member to facilitate toner detachment from the toner-carrying member. The developing system of the present invention utilizes high electrostatic forces to enable toner jump without AC voltages and exploits toner adhesion forces adhering toner particles to a surface (e.g., a latent image-bearing member) to facilitate high speed development.

16 Claims, 7 Drawing Sheets

METHOD OF USING MULTIPLE DEVELOPING MEMBERS IN A SINGLE-COMPONENT DEVELOPING SYSTEM

FIELD OF THE INVENTION

The present invention is directed generally to electrophotography, more particularly, to a non-contact, single-component developing system employing a plurality of ancillary developing members that enables high speed development of electrostatic images and facilitates the consistent reproduction of high quality output images.

BACKGROUND OF THE INVENTION

Electrophotographic imaging process employs a charge-retentive, photosensitive member to form an electrostatic latent image. The latent image is rendered visible by depositing toner particles thereon. The developed particles are then transferred from the latent image to a transfer material such as paper. The resultant powder image deposited on the transfer material is permanently affixed thereto by applying heat and/or pressure, or with solvent vapor.

Color electrophotographic development is achieved by sequentially repeating the development process described above for each color and superimposing the developed images onto one another.

Various developing methods for visualizing electrostatic images are known in the art. One method is known as "non-contact" or "gap-jumping" development, wherein a thin layer of toner particles adhering to a toner-carrying member separated by a "gap" from a latent image-bearing member is brought into the developing region between the toner-carrying member and the latent image-bearing member. A high voltage associated with the latent image on the latent image-bearing member exerts electrostatic forces that direct the toner particles towards the latent image. The electrostatic forces are often of insufficient magnitude to overcome the adhesion forces holding the toner particles in the thin layer on the toner-carrying member. It has been proposed to apply a high AC bias voltage to the developing region in order to overcome the adhesion forces. The AC voltage is of sufficient magnitude to peel the toner particles from the toner-carrying member and allow the toner particles to "jump" the gap between the toner-carrying member and the latent image-bearing member. The toner particles land on the latent image-bearing member to form a developed image. The reciprocal nature of an AC voltage in turn frees the toner particles adhering to the latent image-bearing member from the latent image-bearing member and exerts electrostatic forces that direct the toner particles back to the toner-carrying member. This process is repeated until the latent image area moves far away from the developing region and the toner particles settle on the latent image area. The use of an AC bias has adversary effects on print speed because the rate at which the toner particles oscillate in the developing region (i.e., AC frequency) must be significantly greater than the rate at which the latent image on the latent image-bearing member moves (i.e., the surface moving speed of the latent image-bearing member) and an increase in AC frequency often results in undesirable artifacts such as poor reproducibility of thin character and line images. Furthermore, color developing in the presence of an AC bias requires one latent image-bearing member for each color and an accumulator or some other intermediate transfer member that stores each developed "tone" image, increasing the complexity and cost of the electrophotographic imaging system.

It has been proposed to eliminate the need for AC bias and/or an accumulator using various methods (e.g., by effectively reducing the impact of toner adhesion forces on the development process and thereby facilitating toner jump, or by increasing the thickness of a latent image-bearing member and thereby increasing the potential difference between latent image areas and non-image areas).

It has also been proposed to employ multiple developing rollers to enable high speed, high quality development. However, developing rollers were either sequentially activated, or disposed to repetitively perform substantially the same functions of a single developing roller.

In order to enable high speed development and eliminate the need for an accumulator while fully taking advantage of toner adhesion forces without employing rollers that perform substantially identical functions, a novel developing method capable of further improving the performance and functionality of a single developing roller by employing ancillary developing members is expected.

BRIEF SUMMARY OF THE INVENTION

The present invention is directed to a non-contact, single-component developing system for electrophotographic devices that enables high speed, high quality development and color development without an accumulator, or some other intermediate transfer member by employing a plurality of ancillary developing members such as rotating drums or belts operating in tandem with a toner-carrying member to facilitate toner detachment from the toner-carrying member. The term "non-contact" used in the present invention means that the toner-carrying member is separated by a prescribed gap from the toner-receiving surface of a latent image-bearing member and does not necessarily mean that none of the ancillary developing members are disposed in contact with the latent image-bearing member.

The gap between the toner-carrying member and the latent image-bearing member is larger than a typical gap in a non-contact, single-component developing system and consequently the toner-carrying member is biased (DC only) to a potential that is larger in magnitude (but not large enough to cause arcing between the toner-carrying member and the latent image-bearing member) than a typical DC bias used in such a developing system. The DC bias applied between the toner-carrying member and the latent image-bearing member produces an electrostatic force of insufficient magnitude to overcome toner adhesion forces that adhere toner particles to the toner-carrying member.

The ancillary developing members are strategically disposed and biased to exert supplemental electrostatic forces on toner particles adhering to the toner-carrying member that tend to free the toner particles from the toner-carrying member and direct the toner particles towards the ancillary developing members. Toner particles that are freed from the toner-carrying member due to the combined electrostatic forces fly towards either the latent image-bearing member, or the ancillary developing members, depending on the strengths of the electrostatic forces. The toner particles travel towards the latent image-bearing member if the electrostatic forces exerted in the gap between the toner-carrying member and the latent image-bearing member are of greater magnitude than those exerted in the gap between the toner-carrying member and the ancillary developing members. Conversely, the toner particles travel towards the ancillary developing members if the electrostatic forces exerted in the gap between the toner-carrying member and the latent image-bearing member are of smaller magnitude than those exerted in the gap between the toner-carrying member and the ancillary developing members. Thus, toner particles develop on latent image areas only. When non-image areas on the latent image-bearing member are brought into the region between the toner-carrying member and the ancillary developing members, toner particles either remain on the toner-carrying member, or fly towards and arrive at the ancillary developing members. Therefore, the developing system of the present invention provides improved image quality and eliminates background development. Furthermore, the combined electrostatic forces are sufficient to overcome toner adhesion forces and cause toner jump without the use of AC bias. This enables color development without an accumulator or some other intermediate transfer member.

Once toner particles arrive at the surface of the latent image-bearing member, or the ancillary developing members, the toner particles remain on the destination surface and do not return to the toner-carrying member. Electrostatic forces exerted on the toner particles do not direct the toner particles back to the toner-carrying member. Furthermore, adhesion forces adhering the toner particles to the destination surface cause the toner particles to remain on the destination surface. This advantageous exploitation of adhesion forces and the use of high electrostatic forces to facilitate toner jump enable high speed development that is less sensitive to the surface moving speed of the latent image-bearing member.

DETAILED DESCRIPTION OF PREFERRED EMBODIMENTS

The non-contact, single-component developing system of the present invention enables high-speed development of an electrostatic image and facilitates consistent high quality image reproduction. More particularly, the developing system of the present invention utilizes high electrostatic forces without AC voltages and exploits adhesion forces that adhere toner particles to a toner-carrying member by employing a plurality of ancillary developing members such as rotating drums or belts, whose electrostatic force contributions enable toner particles of various sizes and charges to jump from the toner-carrying member to a latent image-bearing member. Detached toner particles are directed and move in outward directions (i.e., from the toner-carrying member to the latent image-bearing member or the ancillary developing members), causing toner particles to jump the gap only once. Once toner particles are freed from the toner-carrying member, they move rapidly due to the electrostatic forces acting on the toner particles that are of high enough magnitude to overcome toner adhesion forces. This rapid one-way trip to the destination surface allows the developing system to be less sensitive to print speed (i.e., surface moving speed).

Figure 1:
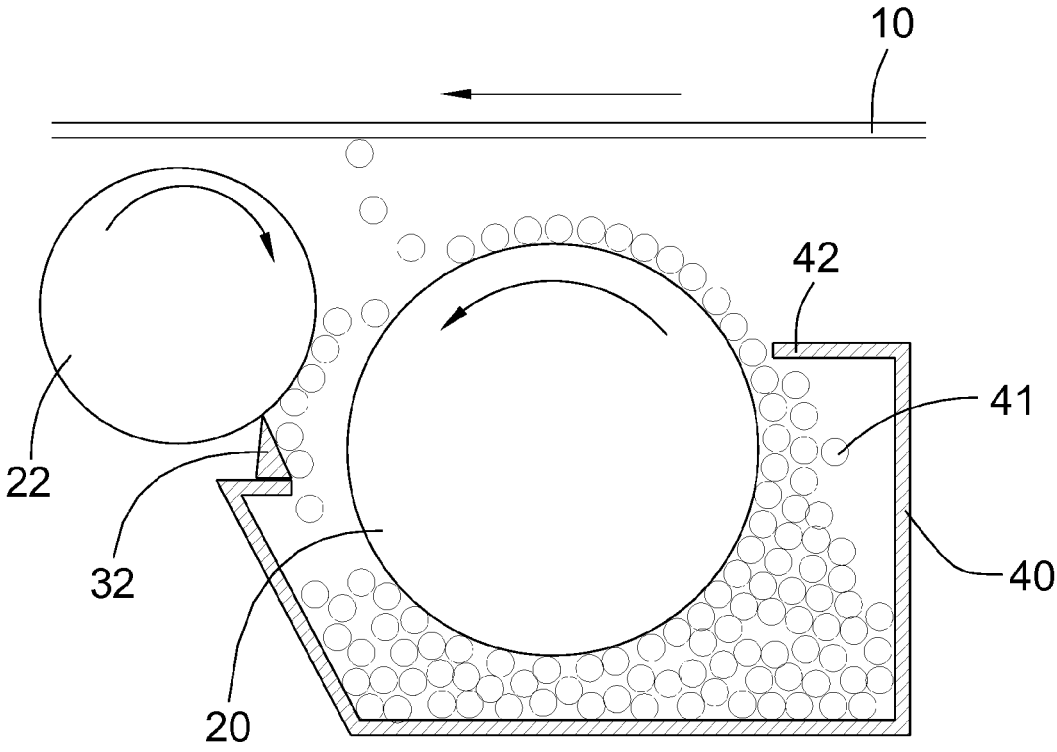
FIG. 1 is a schematic of a non-contact, single-component developing system of the present invention that employs a single ancillary developing member.

Referring in detail to the figures, FIG. 1 shows a non-contact, single-component developing system in accordance with the present invention. The developing system includes a latent image-bearing member 10 such as a photosensitive drum or belt. An electrostatic latent image is formed on the surface of the latent image-bearing member 10 by a latent image forming mechanism or latent image forming means (not shown) and the surface of the latent image-bearing member 10 moves in the direction of an indicated arrow.

The developing system also includes a toner container 40, a toner-carrying member 20, and an ancillary developing member 22. Hereinafter, the ancillary developing member 22 will be referred to as the "post-developer." A metering blade 42 as a toner layer regulating means operates to create a thin layer of toner particles 41 and to charge the toner particles 41 on the toner-carrying member 20. As described in detail below, toner particles that are freed from the toner-carrying member 20 arrive at the latent image-bearing member 10 or the post-developer 22. A cleaning blade 32 removes toner particles transferred to the post-developer 22 and the removed toner particles are collected into the toner container 40.

The surface moving speeds (i.e., circumferential speeds) of the toner-carrying member 20 and the post-developer 22 are substantially identical to the surface moving speed of the latent image-bearing member 10.

The post-developer 22 and the toner-carrying member 20 are disposed to form a gap between the latent image-bearing member 10 and the toner-carrying member 20, a gap between the latent image-bearing member 10 and the post-developer, 22 and a gap between the toner-carrying member 20 and the post-developer 22. Furthermore, the post-developer 22 and the toner-carrying member 20 are disposed in such a way that an electrostatic latent image recorded on the latent image-bearing member 10 passes the toner-carrying member 20 first and then the post-developer 22. The gap between the latent image-bearing member 10 and the toner-carrying member 20 is in the range from about 800 to 2,500 microns, preferably about 1600 microns. The gap between the latent image-bearing member 10 and the post-developer 22 is in the range from 20 to 300 microns, preferably about 100 microns. The gap between the toner-carrying member 20 and the post-developer 22 is in the range from about 500 to 2,000 microns, preferably about 800 microns.

The surface of the latent image-bearing member 10 is initially uniformly charged by a charging mechanism or charging means (not shown) to preferably about −700 V (DC). After exposure of the latent image-bearing member 10 to light to form an electrostatic latent image, the potential of the latent image-bearing member 10 is reduced to approximately −50 V (DC).

A DC bias voltage is applied between the toner-carrying member 20 and the latent image-bearing member 10. The toner-carrying member 20 is biased to a potential in the range of approximately −2,000 to −8,000 V (DC), preferably about −4,500 to −6,000 V (DC), desirably about −5,500 V (DC). The post-developer 22 is biased to a potential between the image area potential and the non-image area potential (i.e., between −700 V and −50 V (DC)), preferably about −400 V (DC). Alternatively, an AC bias voltage having a peak-to-peak value of preferably about 100 V and a frequency of preferably about 5,000 Hz may be applied between the post-developer 22 and the latent image-bearing member 10 in superposition with the DC bias applied therebetween in order to facilitate toner detachment from the toner-carrying member 20.

Although negative DC voltages are used above, it will be understood that positive voltages can also be used in accordance with the present invention by recording positive charge images on the latent image-bearing member 10 and reversing the polarities of DC bias voltages.

Figure 2:
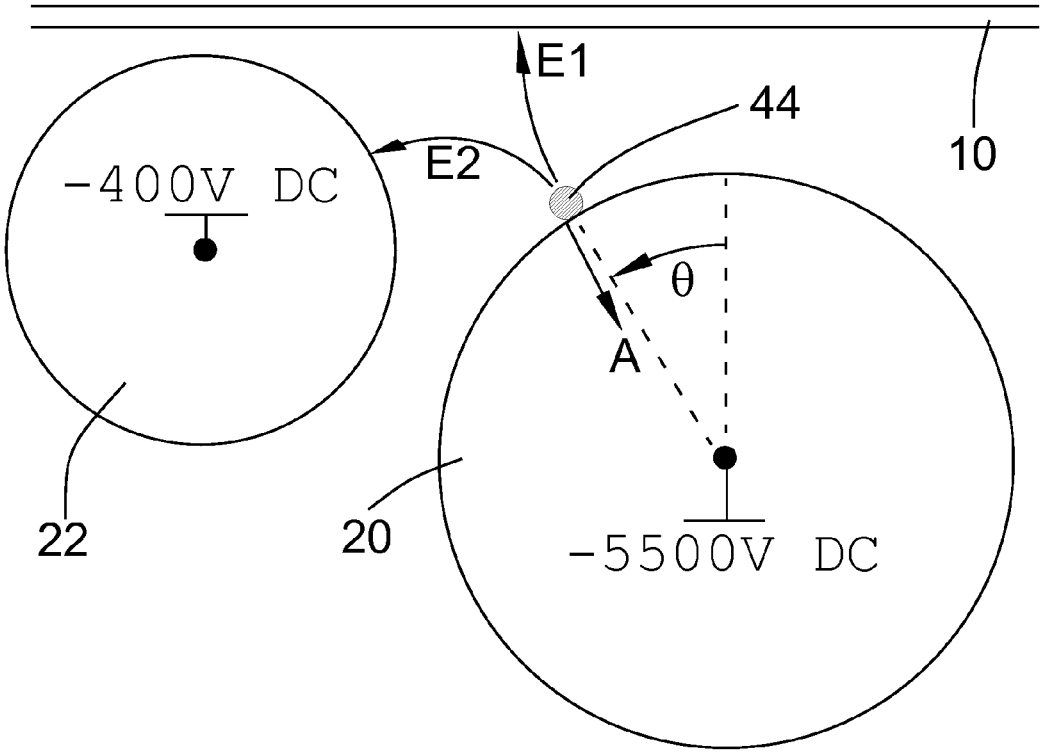
FIG. 2 is a schematic illustrating the forces acting upon a toner particle during the development process.

As shown in FIG. 2, as the toner-carrying member 20 carries the toner near the latent image-bearing member 10 and subsequently towards the post-developer 22, a toner particle 44 experiences electrostatic forces E1 and E2 that tend to free the toner particle 44 from the toner-carrying member 20 and an adhesion force A that adheres the toner particle 44 to the toner-carrying member 20. The electrostatic force E1 directed towards the latent image-bearing member 10 results from the potential difference between the toner-carrying member 20 and the latent image-bearing member 10, and is of insufficient magnitude to overcome the adhesion force A even in the region where the distance between the latent image-bearing member 10 and the toner-carrying member 20 is the shortest (i.e., when E1 is the strongest). Thus, no toner develops until the toner reaches a region that is substantially close to the post-developer 22. The electrostatic force E2 results from the potential difference between the toner-carrying member 20 and the post-developer 22 and directs the toner particle 44 towards the post-developer 22. For the toner particle 44 to be caused to leave the surface of the toner-carrying member 20, the combined electrostatic force (i.e., E1+E2) must be sufficient to overcome the adhesion force A.

Figure 3:
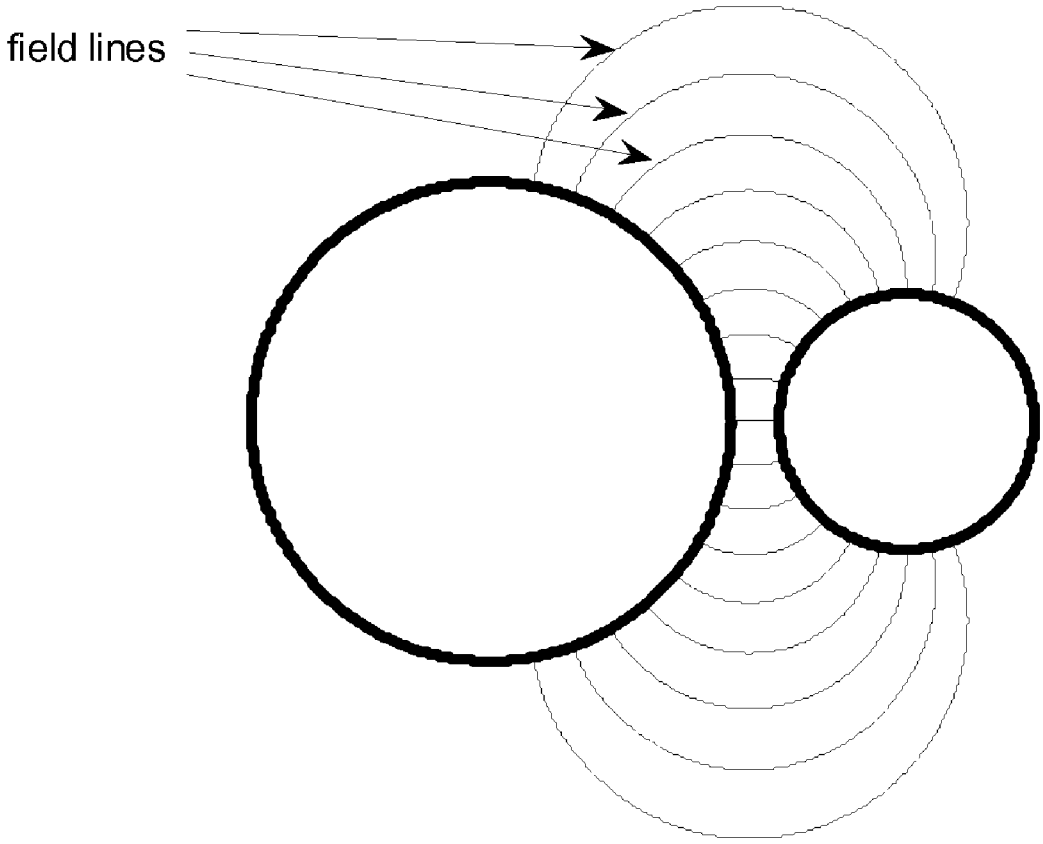
FIG. 3 is a graph showing electric field lines between two cylindrical surfaces.

In general, force is directly proportional to electric field and charge. The electrostatic forces E1 and E2, and the adhesion force A, therefore, may be expressed in terms of electric field. The electrostatic forces E1 and E2 are then approximately $$E1 = \frac{V_{dev} - V_{PC}}{L1} \text{ and } E2 = \frac{V_{dev} - V_{post}}{L2},$$

where $V_{dev}$ is the DC bias applied to the toner-carrying member 20, $V_{PC}$ is the surface potential of the latent image-bearing member 10, $V_{post}$ is the DC bias applied to the post-developer 22, L1 is the field line length between the toner-carrying member 20 and the latent image-bearing member 10, and L2 is the field line length between the toner-carrying member 20 and the post-developer 22. A field line between two surfaces represents a passage along which a charged particle will travel, as illustrated in FIG. 3.

Figure 4:
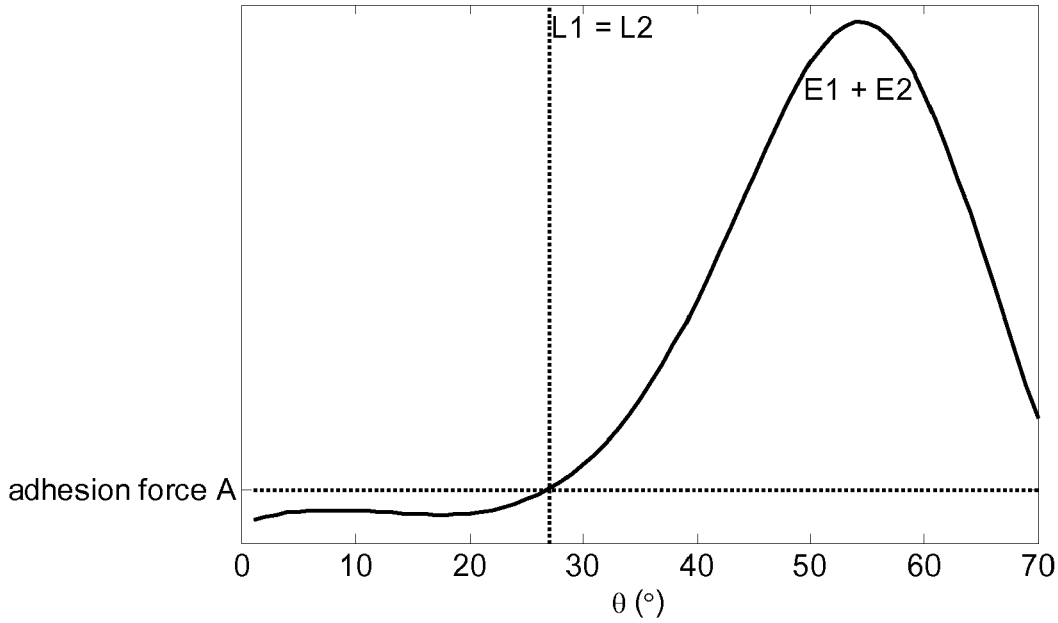
FIG. 4 is a graph showing the combined electrostatic force as a function of toner-carrying member rotation angle.

FIG. 4 shows an example plot of the combined electrostatic force E1+E2 as a function of rotation angle θ of the toner-carrying member 20 (see FIG. 2) where $V_{PC}$=−50 V (DC). The combined electrostatic force E1+E2 is of sufficient magnitude to overcome the adhesion force A when the rotation angle θ is approximately 27° in FIG. 4. Incidentally, the field line lengths L1 and L2 are approximately equal when θ=27°. But the line representing L1=L2 may shift left and right and/or the curve E1+E2 may shift up and down depending on the values of the parameters discussed above such as the DC bias voltages.

According to the example illustrated in FIG. 4, the toner particle 44 is freed from the toner-carrying member 20 when the rotation angle θ is 27° due to the combined electrostatic force E1+E2 that exceeds the adhesion force A and flies towards either the latent image-bearing member 10, or the post-developer 22, depending on the strengths of the electrostatic forces E1 and E2. The toner particle 44 travels towards the latent image-bearing member 10 if the surface potential of the latent image-bearing member 10 is approximately −50 V (DC) (i.e., image area) because the potential difference between the latent image-bearing member 10 and the toner-carrying member 20 is greater than that between the toner-carrying member 20 and the post-developer 22 (i.e., E1>E2 because L1=L2, see the equations above). Conversely, the toner particle 44 travels towards the post-developer 22 if the electrostatic force E2 exerted in the gap area between the toner-carrying member 20 and the post-developer 22 is of greater magnitude than the electrostatic force E1 exerted in the gap area between the latent image-bearing member 10 and the toner-carrying member 20. Since E2>E1 when the surface potential of the latent image-bearing member 10 is approximately −700 V (DC), a non-image area does not attract and receive the toner particle 44.

In addition to the electrostatic forces E1 and E2, the potential difference between the post-developer 22 and the latent image-bearing member 10 creates an additional electrostatic force that directs the toner particle 44 towards the latent image-bearing member 10 if the surface potential of the latent image-bearing member 10 is approximately −50 V (DC), or towards the post-developer 22 if the surface potential of the latent image-bearing member 10 is approximately −700 V (DC). Therefore, the DC bias applied to the post-developer 22 further ensures that toner particles develop on latent image areas only. When non-image areas are brought between the toner-carrying member 20 and the post-developer 22, toner particles simply fly towards and arrive at the post-developer 22.

From FIG. 4, a toner particle that exhibits a stronger adhesion force is detached from the toner-carrying member 20 when the rotation angle θ is greater than 27° and the particle is subject to the identical developing mechanism as described above. That is, the particle will develop on an image area recorded on the latent image-bearing member 10, or land on the post-developer 22, but will not be attracted to a non-image area on the latent image-bearing member 10. Thus, the developing system of the present invention is capable of consistently producing high quality output images.

Once toner particles leave the toner-carrying member 20, due to the high electrostatic forces exerted on those particles, they tend to travel rapidly and quickly arrive at the surface of the latent image-bearing member 10, or the post-developer 22. Adhesion forces that adhere the transferred toner particles to the destination surface and electrostatic forces exerted on the transferred toner particles tend to hold the toner particles to the destination surface. Therefore, the developing system of the present invention does not allow toner particles that leave the toner-carrying member 20 and arrive at a destination surface to return to the toner-carrying member 20. High electrostatic and adhesion forces cause the transferred toner particles to remain on the destination surface. This advantageous exploitation of adhesion forces and rapid toner travel to the destination surface enable high speed development of electrostatic images that is less sensitive to an increase in the surface moving speed of the latent image-bearing member 10.

The developing system of the present invention also eliminates wrong-signed toner development. Wrong-signed toner development causes various undesirable artifacts such as foggy background (i.e., non-image area development). Because of the high negative DC bias applied to the toner-carrying member 20, wrong-signed toner particles (i.e., positively charged particles) remain on the surface of the toner-carrying member 20, completely eliminating the possibility of developing those positively charged particles.

Figure 5:
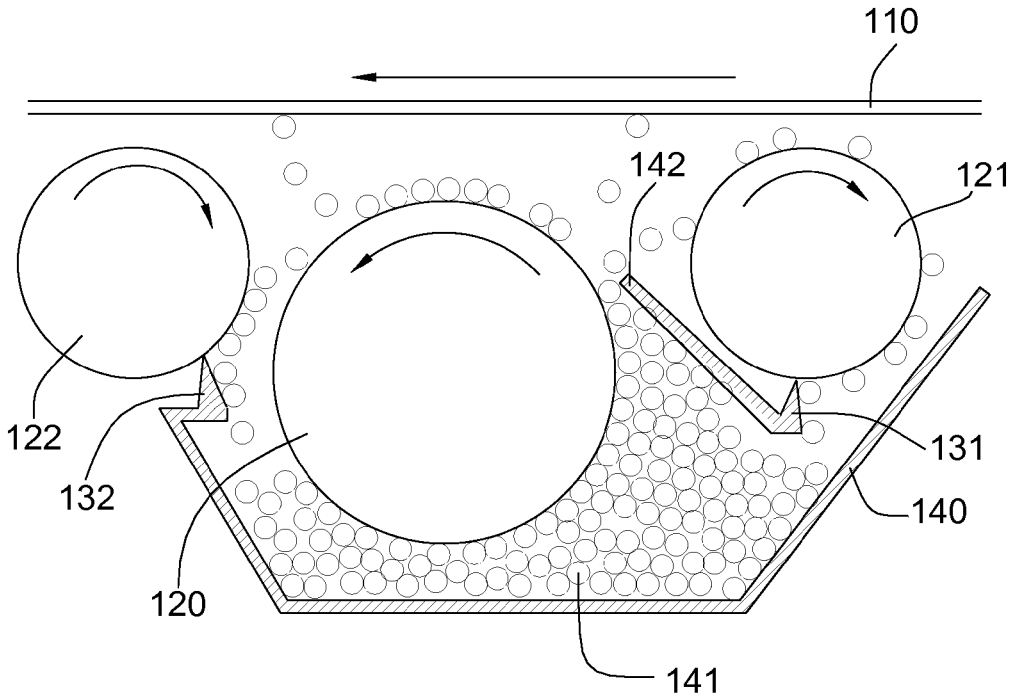
FIG. 5 is a schematic of a non-contact, single-component developing system of the present invention that employs two ancillary developing members.

FIG. 5 shows another preferred embodiment of the present invention. The non-contact, single-component developing system shown in FIG. 5 includes a latent image-bearing member 110 such as a photosensitive drum or belt, a toner-carrying member 120, and two ancillary developing members 121 and 122. Hereinafter, the first ancillary developing member 121 will be referred to as the "pre-developer," and the second ancillary developing member 122 as the "post-developer."

The developing system also includes a toner container 140, a metering blade 142, and two cleaning blades 131 and 132. The metering blade 142 operates to create a thin layer of toner particles 141 and to charge the toner particles 141 on the toner-carrying member 120 from the toner container 140. As described in detail below, toner particles that are freed from the toner-carrying member 120 develop on the latent image-bearing member 110, or land on the pre-developer 121 or the post-developer 122. The cleaning blades 131 and 132 remove toner particles transferred to the pre-developer 121 and post-developer 122, respectively, and the removed toner particles are collected into the toner container 140.

The surface moving speeds (i.e., circumferential speeds) of the toner-carrying member 120, and the post-developer 122 are substantially identical to the surface moving speed of the latent image-bearing member 110. The surface moving speed of the pre-developer 121, however, is significantly greater than that of the latent image-bearing member 110, and is preferably about twice the surface moving speed of the latent image-bearing member 110.

The latent image-bearing member 110, the pre-developer 121, the post-developer 122, and the toner-carrying member 120 are disposed to form a gap between the latent image-bearing member 110 and the toner-carrying member 120, a gap between the latent image-bearing member 110 and the pre-developer 121, a gap between the toner-carrying member 120 and the pre-developer 121, a gap between the latent image-bearing member 110 and the post-developer 122, and a gap between the toner-carrying member 120 and the post-developer 122. Furthermore, the pre-developer 121, the post-developer 122, and the toner-carrying member 120 are disposed in such a way that an electrostatic latent image recorded on the latent image-bearing member 110 passes the pre-developer 121 first, then passes the toner-carrying member 120, and lastly passes the post-developer 122. Preferably, the gap between the latent image-bearing member 110 and the toner-carrying member 120 is approximately 1,600 microns; the gap between the latent image-bearing member 110 and the pre-developer 121 is approximately 100 microns; the gap between the toner-carrying member 120 and the pre-developer 121 is approximately 1,500 microns; the gap between the latent image-bearing member 110 and the post-developer 122 is approximately 100 microns; and the gap between the toner-carrying member 120 and the post-developer 122 is approximately 800 microns.

The surface of the latent image-bearing member 110 is initially uniformly charged by a charging mechanism or charging means (not shown) to preferably about −700 V (DC). Subsequently, an electrostatic latent image is formed on the surface of the latent image-bearing member 110 by a latent image forming mechanism or latent image forming means (not shown). After exposure of the latent image-bearing member 110 to light, the potential of the latent image-bearing member 110 is reduced to approximately −50 V (DC).

A DC bias voltage is applied between the toner-carrying member 120 and the latent image-bearing member 110. The toner-carrying member 120 is preferably biased to a potential in the range of approximately −4,500 to −6,000 V (DC). The pre-developer 121 and the post-developer 122 are biased to potentials between the image area potential and the non-image area potential (i.e., between −700 V and −50 V (DC). Preferably, the potential of the pre-developer 121 and the post-developer 122 is approximately −400 V (DC).

As the toner-carrying member 120 carries the toner 141 towards the pre-developer 121, toner particles that are adhered to the toner-carrying member 120 by relatively weak adhesion forces are freed from the toner-carrying member 120 and transferred to the pre-developer 121. The pre-developer 121 carries the transferred toner particles into the gap between the latent image-bearing member 110 and the pre-developer 121. The difference between the bias voltage on the pre-developer 121 (−400 V) and the image area potential (−50 V) on the latent image-bearing member 110 may exert a force of sufficient magnitude on the transferred toner particles to overcome the weak adhesion forces and cause the toner particles to jump the gap between the pre-developer 121 and the latent image-bearing member 110. The difference between the bias voltage on the pre-developer 121 (−400 V) and the non-image area potential (−700 V) exerts a force on the transferred toner particles that directs the transferred toner particles towards the pre-developer 121 and hence causes the transferred toner particles to remain on the pre-developer 121. Thus, the transferred toner particles develop on image areas on the latent image-bearing member 110, but not on non-image areas. Alternatively, provided that only a negligible amount of toner development occurs in the gap between the latent image-bearing member 110 and the pre-developer 121, the pre-developer 121 may rotate in the opposite direction of an indicated arrow in FIG. 5, in which case toner particles that are transferred to the pre-developer 121 will not be carried into the gap between the latent image-bearing member 110 and the pre-developer 121 and will be brought back towards to toner container 140 and scraped off into the toner container 140.

Figure 6:
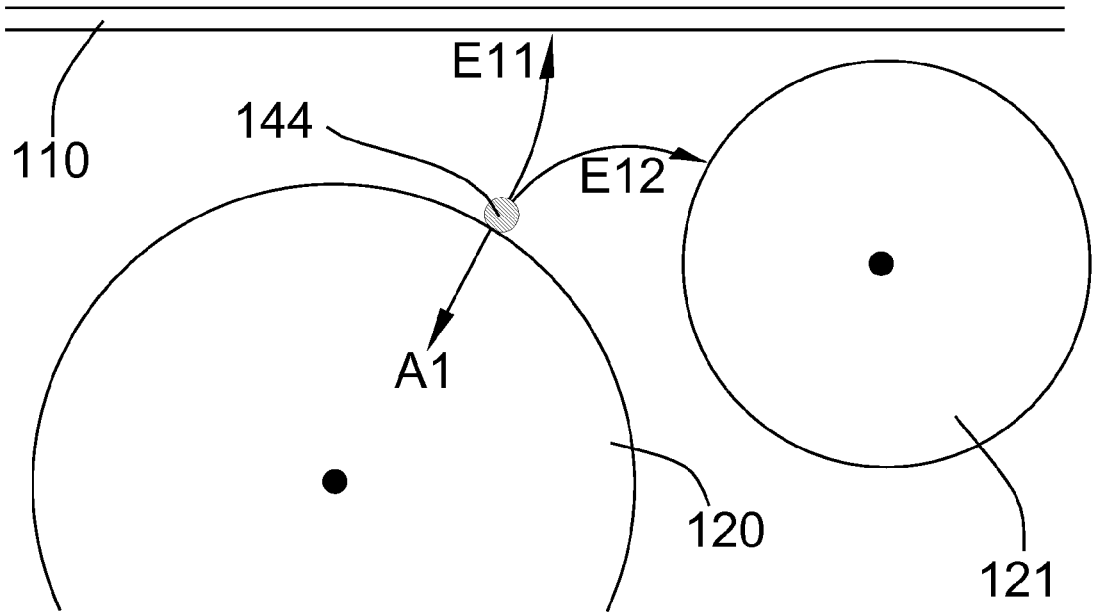
FIG. 6 is a schematic illustrating the forces acting upon a toner particle during the first stage of the development process.

Particles that are not transferred to the pre-developer 121 are brought towards the latent image-bearing member 110. As shown in FIG. 6, a toner particle 144 that is exposed to both the pre-developer 121 and the latent image-bearing member 110 experiences electrostatic forces E11 and E12 that tend to free the toner particle 144 from the toner-carrying member 120 and an adhesion force A1 that adheres the toner particle 144 to the toner-carrying member 120. The electrostatic force E11 directed towards the latent image-bearing member results from the potential difference between the toner-carrying member 120 and the latent image-bearing member 110. The electrostatic force E12 results from the potential difference between the toner-carrying member 120 and the pre-developer 121 and directs the toner particle 144 towards the pre-developer 121. If the combined electrostatic force (i.e., E11+E12) is not sufficient to overcome the adhesion force A1, the toner particle 144 remains on the toner-carrying member 120 and subsequently the toner-carrying member 120 carries the toner particle 144 towards the post-developer 122. On the other hand, If the combined electrostatic force (i.e., E11+E12) is sufficient to overcome the adhesion force A1, the toner particle 144 is caused to leave the surface of the toner-carrying member 120, and the strengths of the electrostatic forces E11 and E12 determine its destination surface. That is, if the electrostatic force E11 is greater than E12, the particle 144 flies towards the latent image-bearing member 110, else it flies towards the pre-developer 121.

In addition to the electrostatic forces described above, the high surface moving speed of the pre-developer 121 creates a windage that directs the toner particle 144 towards the latent image-bearing member 110, facilitating the development of the particle 144 when the electrostatic force E12 is slightly greater than the electrostatic force E11 and the surface potential of the latent image-bearing member 110 is approximately −50 V.

In essence, the pre-developer 121 develops toner particles that are held by relatively weak adhesion forces (e.g., improperly charged particles and particles with small contact areas), or transfers those particles to the pre-developer 121. This eliminates the possibility of undesirable development when toner particles are carried into the region between the toner-carrying member 120 and the latent image-bearing member 110, and hence removes undesirable artifacts such as foggy background (i.e., non-image area development).

Particles that are brought near the post-developer 122 are subject to the same developing mechanism described in the previous embodiment shown in FIG. 1. When the sum of the electrostatic forces resulting from the potential difference between the toner-carrying member 120 and the latent image-bearing member 110 and from the potential difference between the toner-carrying member 120 and the post-developer 122 is sufficient to overcome the adhesion forces that adhere the toner particles to the toner-carrying member 120, the toner particles are caused to leave the surface of the toner-carrying member 120. The toner particles travel towards the latent image-bearing member 110 if the surface potential of the latent image-bearing member 110 is approximately −50 V (i.e., image area). Conversely, the toner particles travel towards the post-developer 122 if the surface potential of the latent image-bearing member 110 is approximately −700 V (i.e., non-image area). Also, the potential difference between the post-developer 122 and the latent image-bearing member 110 creates an additional electrostatic force that directs the toner particles towards the latent image-bearing member 110 if the surface potential of the latent image-bearing member 110 is approximately −50 V, or towards the post-developer 122 if the surface potential of the latent image-bearing member 110 is approximately −700 V. Therefore, the DC bias applied to the post-developer 122 further ensures that toner particles develop on latent image areas only. When non-image areas are brought between the toner-carrying member 120 and the post-developer 122, the toner particles simply fly towards and arrive at the post-developer 122.

The two ancillary developing members 121 and 122 operate in tandem with the toner-carrying member 120 to develop toner particles on image areas only. The developing system improves print quality and reproducibility by employing a double-pass development scheme. During each pass, the combined electrostatic forces are sufficient to cause toner particles to jump from the toner-carrying member 120 without the use of an AC bias. This enables color development without an accumulator or some other intermediate transfer member.

Figure 7:
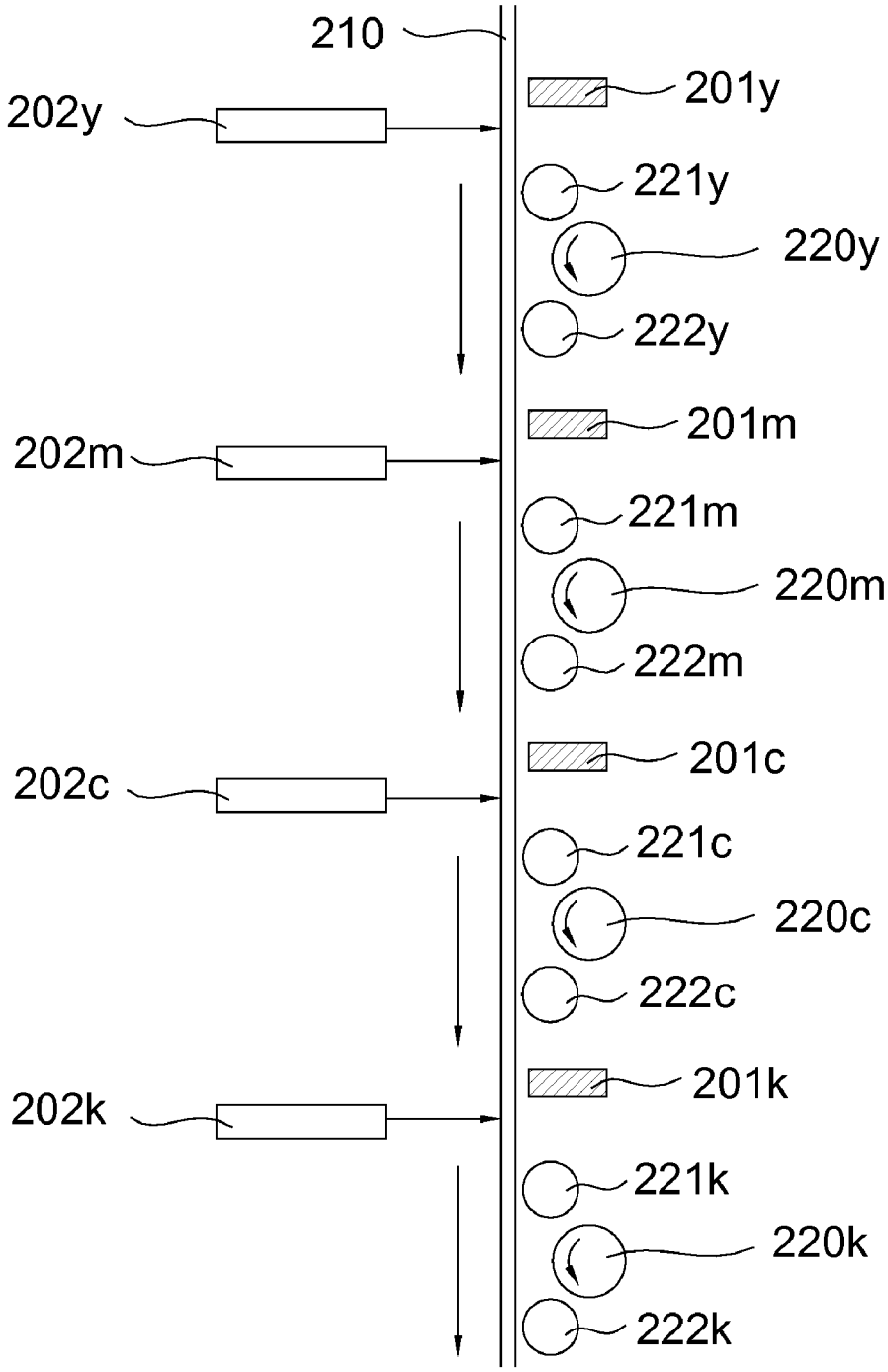
FIG. 7 is a schematic of a non-contact, single-component color developing system in accordance with the present invention that employs two ancillary developing members for each color.

FIG. 7 shows a non-contact, single-component color developing system in accordance with the present invention. The color developing system includes a latent image-bearing member 210 such as a photosensitive drum or belt, four toner-carrying members 220*y*, 220*m*, 220*c*, and 220*k*, four pre-developers 221*y*, 221*m*, 221*c*, and 221*k*, and four post-developers 222*y*, 222*m*, 222*c*, and 222*k*.

The first toner-carrying member 220*y* carries yellow toner (not shown) into the first developing region defined by the latent image-bearing member 210, the first pre-developer 221*y*, the first toner-carrying member 220*y*, and the first post-developer 222*y*; the second toner-carrying member 220*m* carries magenta toner (not shown) into the second developing region defined by the latent image-bearing member 210, the second pre-developer 221*m*, the second toner-carrying member 220*m*, and the second post-developer 222*m*; the third toner-carrying member 220*c* carries cyan toner (not shown) into the third developing region defined by the latent image-bearing member 210, the third pre-developer 221*c*, the third toner-carrying member 220*c*, and the third post-developer 222*c*; and the fourth toner-carrying member 220*k* carries black toner (not shown) into the fourth developing region defined by the latent image-bearing member 210, the fourth pre-developer 221*k*, the fourth toner-carrying member 220*k*, and the fourth post-developer 222*k*.

The pre-developer 221*y* and the post-developer 222*y* operate in tandem with the toner-carrying member 220*y* to develop the yellow toner on the latent image-bearing member 210; the pre-developer 221*m* and the post-developer 222*m* operate in tandem with the toner-carrying member 220*m* to develop the magenta toner on the latent image-bearing member 210; the pre-developer 221*c* and the post-developer 222*c* operate in tandem with the toner-carrying member 220*c* to develop the cyan toner on the latent image-bearing member 210; and the pre-developer 221*k* and the post-developer 222*k* operate in tandem with the toner-carrying member 220*k* to develop the black toner on the latent image-bearing member 210.

The four toner-carrying members 220*y*, 220*m*, 220*c*, and 220*k*, the four pre-developers 221*y*, 221*m*, 221*c*, and 221*k*, and the four post-developers 222*y*, 222*m*, 222*c*, and 222*k* are substantially similarly DC biased as in the previous embodiment shown in FIG. 5.

The color developing system also includes four charging means 201*y*, 201*m*, 201*c*, and 201*k*, and four latent image forming mechanisms or latent image forming means 202*y*, 202*m*, 202*c*, and 202*k* such as LED arrays.

The color developing system operates as follows. The first charging means 201*y* uniformly charges the latent image-bearing member 210 to approximately −700 V (DC). Subsequently, an electrostatic latent image is formed on the surface of the latent image-bearing member 210 by the first latent image forming mechanism 202*y*. The potential of the exposed portions of the latent image-bearing member 210 is reduced to approximately −50 V (DC). As the latent image on the latent image-bearing member 210 is brought into the first developing region, the yellow toner particles develop on the image areas as described in the previous embodiment shown in FIG. 5. The second charging means 201*m* then uniformly charges the latent image-bearing member 210 again to approximately −700 V (DC) and the second latent image forming mechanism 202*m* shines light onto specific portions of the latent image-bearing member 210 that require the inclusion of the color magenta. The potential of those exposed portions of the latent image-bearing member 210 is reduced to approximately −50 V (DC) if no toner is deposited thereon, and to approximately −200 V (DC) if toner particles are already deposited thereon. Thus, the potential difference between light exposed portions of the latent image-bearing member 210 and the second toner-carrying member 220*m* is reduced by approximately 150 V (DC) when magenta toner particles are to be deposited on top of yellow toner particles. However, the reduction in potential difference is of insignificant magnitude when compared against the high DC bias applied between the second toner-carrying member 220*m* and the latent image-bearing member 210. In fact, the reduction in potential difference (150 V) corresponds to less than 4% of the DC bias applied between the toner-carrying member 220*m* and the latent image-bearing member 210 and hence the corresponding reduction in electrostatic forces from the reduction in potential difference has little impact on the development of magenta toner particles. After magenta toner particles are developed, the process is repeated for the two remaining colors.

Once toner particles land on the latent image-bearing member 210, or on toner particles already deposited on the latent image-bearing member 210, electrostatic forces exerted on the toner particles and adhesion forces adhering the toner particles to the latent image-bearing member 210 and to each other cause the toner particles to remain on the latent image-bearing member 210. This advantageous exploitation of electrostatic forces and adhesion forces enables efficient, reliable accumulation of different color toner particles on the latent image-bearing member 210, resulting in consistent production of high quality output images.

The foregoing description of the various embodiments and principles of the inventions have been presented for the purposes of illustration and description. It is not intended to be exhaustive or to limit the invention to the precise forms disclosed. Many alternatives, modifications, and variations will be apparent to those skilled in the art. Moreover, although various inventive concepts have been presented, such aspects need not to be utilized in combination, and various combinations of inventive aspects are possible in light of the various embodiments provided above. Accordingly, the above description is intended to embrace all possible alternatives, modifications, combinations and variations that have been discussed or suggest herein, as well as all others that fall within the principles, spirit and broad scope of the invention as defined by the claims.

What is claimed is:

1. A non-contact, single-component developing system comprising:

a latent image-bearing member capable of having an electrostatic latent image recorded thereon, a toner-carrying member for carrying a layer of a toner thereon, a first plurality of ancillary developing members, a second plurality of ancillary developing members and toner removing means for removing the toner from the first and second plurality of ancillary developing members, wherein a DC bias voltage is applied between the toner-carrying member and the latent image-bearing member;

a DC bias voltage is applied between at least one of the first plurality of ancillary developing members and the latent image-bearing member;

a DC bias voltage is applied between at least one of the second plurality of ancillary developing members and the latent image-bearing member;

the latent image-bearing member and the toner-carrying member are disposed to form a prescribed gap therebetween;

the latent image-bearing member passes the first plurality of ancillary developing members prior to passing the toner-carrying member;

the latent image-bearing member passes the second plurality of ancillary developing members after passing the toner-carrying member;

the surface of at least one of the first plurality of ancillary developing members moves at a constant velocity;

the first plurality of ancillary developing members facilitate toner jump from the toner-carrying member by producing electrostatic forces that direct the toner away from the toner-carrying member;

the surface of at least one of the second plurality of ancillary developing members moves at a constant velocity;

the second plurality of ancillary developing members facilitate toner jump from the toner-carrying member by producing electrostatic forces that direct the toner away from the toner-carrying member;

the toner jumps from the toner-carrying member and selectively lands on either the latent image-bearing member, at least one of the first plurality of ancillary developing members, or at least one of the second plurality of ancillary developing members;

the toner on at least one of the first plurality of ancillary developing members and at least one of the second plurality of ancillary developing members is removed by the toner removing means.

2. The developing system of claim 1 wherein the second plurality of ancillary developing members are removed and the first plurality of ancillary developing members comprise of an ancillary developing member disposed to form a gap between the latent image-bearing member and the ancillary developing member and a gap between the toner-carrying member and the ancillary developing member.

3. The developing system of claim 1 wherein the first plurality of ancillary developing members are removed and the second plurality of ancillary developing members comprise of an ancillary developing member disposed to form a gap between the latent image-bearing member and the ancillary developing member and a gap between the toner-carrying member and the ancillary developing member.

4. The developing system of claim 1 wherein the first plurality of ancillary developing members comprise of a first ancillary developing member; and the second plurality of ancillary developing members comprise of a second ancillary developing member.

5. The developing system of claim 4 wherein the first ancillary developing member is disposed to form a gap between the latent image-bearing member and the first ancillary developing member and a gap between the toner-carrying member and the first ancillary developing member; and the second ancillary developing member is disposed to form a gap between the latent image-bearing member and the second ancillary developing member and a gap between the toner-carrying member and the second ancillary developing member.

6. The developing system of claim 5 wherein the gap between the latent image-bearing member and the toner-carrying member is 600 to 2,500 μm; the gap between the first ancillary developing member and the toner-carrying member is 500 to 2,000 μm; the gap between the second ancillary developing member and the toner-carrying member is 500 to 2,000 μm; the gap between the latent image-bearing member and the first ancillary developing member is 20 to 250 μm; and the gap between the latent image-bearing member and the second ancillary developing member is 20 to 250 μm.

7. The developing system of claim 6 wherein the DC bias voltage applied between the toner-carrying member and the latent image-bearing member has a magnitude of 2,000 to 8,000 V; the DC bias voltage applied between the first ancillary developing member and the latent image-bearing member has a magnitude of 200 to 600 V; and the DC bias voltage applied between the second ancillary developing member and the latent image-bearing member has a magnitude of 200 to 600 V.

8. The developing system of claim 7 wherein the latent image-bearing member and the toner-carrying member rotate in the same direction at a position where the latent image-bearing member faces the toner-carrying member; the toner-carrying member and the second ancillary developing member rotate in the same direction at a position where the toner-carrying member faces the second ancillary developing member; and the toner-carrying member and the first ancillary developing member rotate in the same direction at a position where the toner-carrying member faces the first ancillary developing member.

9. The developing system of claim 8 wherein the surface moving speeds of the latent image-bearing member, the toner-carrying member, the first ancillary developing member, and the second ancillary developing member are substantially identical.

10. The developing system of claim 8 wherein the surface moving speeds of the latent image-bearing member, the toner-carrying member, and the second ancillary developing member are substantially identical; and the surface moving speed of the first ancillary developing member is substantially greater than that of the latent image-bearing member.

11. The developing system of claim 7 wherein an AC bias voltage having a peak-to-peak value of 50 to 200 V and a frequency of 2,000 to 10,000 Hz is applied between the first ancillary developing member and the latent image-bearing member in superposition with the DC bias voltage applied between the first ancillary developing member and the latent image-bearing member; and an AC bias voltage having a peak-to-peak value of 50 to 200 V and a frequency of 2,000 to 10,000 Hz is applied between the second ancillary developing member and the latent image-bearing member in superposition with the DC bias voltage applied between the second ancillary developing member and the latent image-bearing member.

12. The developing system of claim 4 comprising a light source and a charge source electrically coupled to the latent image-bearing member.

13. The developing system of claim 12 wherein the charge source comprises a plurality of charging members; the light source comprises a plurality of light emitting members; the toner-carrying member comprises a plurality of toner-carrying rollers; the first ancillary developing member comprises a first plurality of ancillary developing members; and the second ancillary developing member comprises a second plurality of ancillary developing members.

14. The developing system of claim 13 wherein the plurality of light emitting members comprise four light-emitting-diode arrays; the plurality of charging members comprise four charging members; the plurality of toner-carrying rollers comprise four toner-carrying rollers; the first plurality of ancillary developing members comprise four ancillary developing members; and the second plurality of ancillary developing members comprise four ancillary developing members.

15. The developing system of claim 14 wherein the toner comprises four color toners.

16. The developing system of claim 1 wherein the toner removing means comprises a plurality of blades disposed in close proximity to the first and the second plurality of ancillary developing members.

* * * * *